US005678703A

United States Patent [19]

Sawyer

[11] Patent Number: 5,678,703

[45] Date of Patent: Oct. 21, 1997

[54] FINIAL ADAPTER FOR CURTAIN RODS

[76] Inventor: Gerald F. Sawyer, 2862 Tree Top Rd., Dacula, Ga. 30211

[21] Appl. No.: 509,176

[22] Filed: Jul. 31, 1995

[51] Int. Cl.[6] ..... A47H 1/02

[52] U.S. Cl. ..... 211/105.1; 211/105.2; 428/28

[58] Field of Search ..... 211/105.1, 105.2, 211/180; 52/300, 301; 362/351, 353; 428/28; D8/376, 378, 387; D26/118; 248/251, 261; 411/388, 389

[56] References Cited

U.S. PATENT DOCUMENTS

| | | | |
|---|---|---|---|
| 298,592 | 5/1884 | Kroder | 428/28 |
| 648,760 | 5/1900 | Kolb | 211/105.2 X |
| 904,229 | 11/1908 | Robinson | 211/105.1 X |
| 1,477,524 | 12/1923 | Ruttenberg | 428/28 |
| 1,509,330 | 9/1924 | Wyatt | 211/105.1 |
| 2,311,838 | 2/1943 | Koch | 428/28 |
| 2,312,185 | 2/1943 | Neunherz | 411/389 X |
| 2,374,787 | 5/1945 | Spiegel et al. | 211/105.1 |
| 2,492,517 | 12/1949 | Bernick | 211/105.1 X |
| 4,108,560 | 8/1978 | Minogue | 411/389 X |
| 4,223,051 | 9/1980 | Warshawsky | D8/378 X |
| 4,541,038 | 9/1985 | Van Noord | 362/353 X |

*Primary Examiner*—Alvin C. Chin-Shue
*Assistant Examiner*—Sandra Snapp
*Attorney, Agent, or Firm*—James B. Middleton

[57] ABSTRACT

A large diameter curtain rod has a small, lamp shade finial fixed to the ends through an adapter. The adapter may have a screw with a wood-screw thread on one end and a machine-screw thread on the other. The wood-screw thread is inserted into the rod, and the finial is screwed onto the machine-screw thread. When the finial thread does not match the screw thread, a bushing is used to adapt the screw thread. An end cap can cover the end of the rod and be held in place by the bushing or the finial. For metal rods, an end cap has a female thread to engage the rod; and, a threaded stud for receiving a finial extends from the end cap.

8 Claims, 1 Drawing Sheet

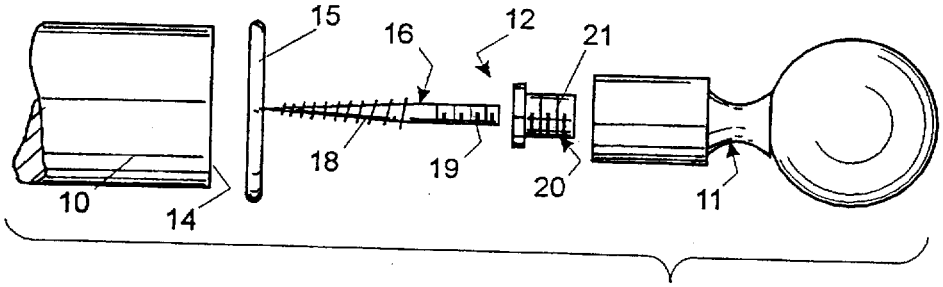
Fig. 1
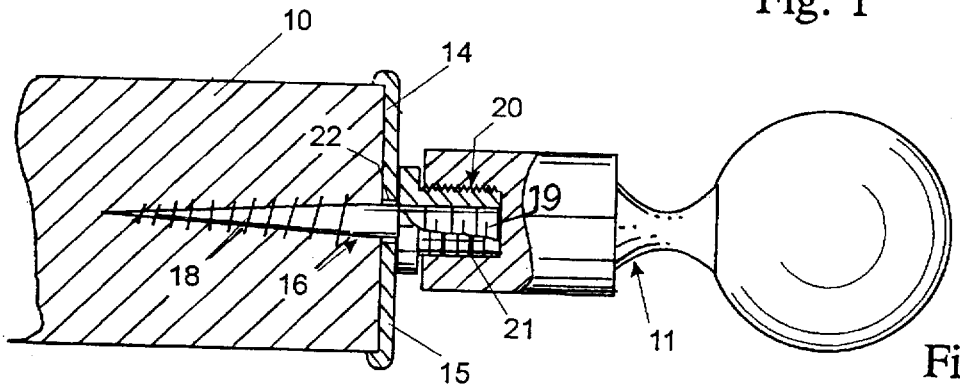
Fig. 2
Fig. 3
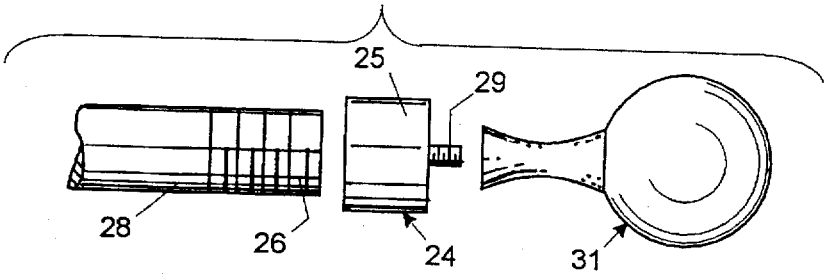
Fig. 4
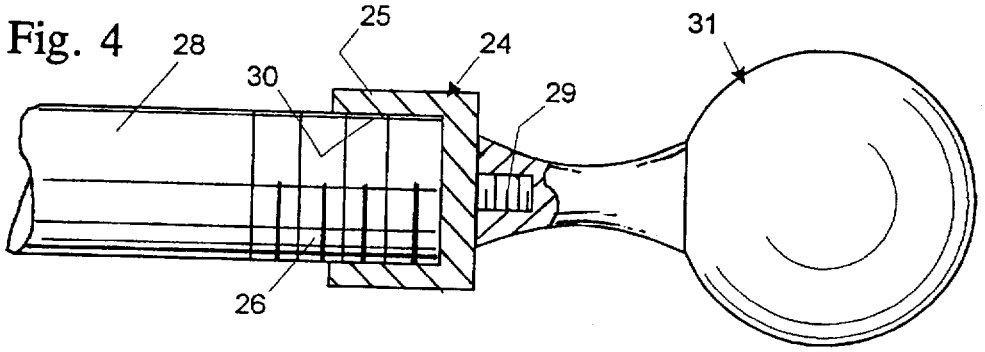

FINIAL ADAPTER FOR CURTAIN RODS

BACKGROUND OF THE INVENTION

1. Field of the Invention

This invention relates generally to curtain rods, and is more particularly concerned with an adapter for attaching a relatively small finial to a relatively large curtain rod.

2. Discussion of the Prior Art

A very popular form of curtain rod comprises a generally straight rod member which receives rings thereover, the rings carrying the curtain, draperies or the like. Such rods typically are in the vicinity of 2 inches (5 cm.) in diameter. The finials available for these curtain rods generally have an opening therein sized to receive an end of the curtain rod. The curtain rod acts as the male member and the opening in the finial acts as the female member. Considering the size of the curtain rod, it will be readily understood that the finial must be quite large in order to define an opening of the necessary size. Typically, such finials have a length of around 5 to 8 inches (12 to 20 cm.). Such a large finial is truly imposing in a normal sized room.

As a result of the above stated facts, many people who wish to use the large curtain rods simply omit the finial, leaving the end of the rod exposed. While the end, when of wood, may be finished, it will be understood that the end-grain is very difficult to finish well, and special techniques are required.

While other, smaller, finials are readily available, there has been no means for fixing these smaller finials to the large curtain rods. The smaller finials are primarily designed for use on lamp shades and the like, and the means for mounting a lamp shade finial is vastly different from the above described means for mounting a curtain rod finial. As a result, the prior art has not provided a small finial for use on a curtain rod, and has provided no means for adapting another finial to a curtain rod.

SUMMARY OF THE INVENTION

The present invention provides an adapter for fixing a lamp shade finial or the like to the end of a large curtain rod. For curtain rods made of wood or the like a screw having a wood-screw thread on one end and a machine-screw thread on the opposite end is screwed into the curtain rod. A bushing is threaded onto the machine-screw thread to adapt the thread to the standard finial base thread. A lamp shade finial is then receivable on the bushing.

In the preferred embodiment of the invention, an end cap covers the end of the curtain rod, and is held in place by the finial and bushing assembly.

It will be recognized by those skilled in the art that one might utilize a custom-made screw having the wood-screw thread on one end and the standard finial-base thread on the other. This would obviate the need for the bushing and would yield the same result. Also, one might assemble the pieces as described above, and glue or otherwise fix the pieces together so there is effectively one piece.

Some curtain rods are made of steel rather than wood, and have threaded ends. The adapter for these steel rods in accordance with the present invention includes a female threaded end to be threadedly engaged with the curtain rod, and a finial-base thread on the opposite end. As before, then, a conventional lamp-shade finial can be fixed to the adapter.

BRIEF DESCRIPTION OF THE DRAWINGS

These and other features and advantages of the present invention will become apparent from consideration of the following specification when taken in conjunction with the accompanying drawings in which:

FIG. 1 is an exploded view showing an adapter made in accordance with the present invention in proper relationship with a curtain rod and a finial;

FIG. 2 is an enlarged, side elevational view, partially in cross-section, showing the apparatus of FIG. 1 assembled;

FIG. 3 is a view similar to FIG. 1 showing a modified form of the invention; and, FIG. 4 is a view similar to FIG. 2 showing the embodiment of FIG. 3.

DETAILED DESCRIPTION OF THE EMBODIMENTS

Referring now more particularly to the drawings, and to that embodiment of the invention shown in FIG. 1, one end of a curtain rod 10 is shown. A finial 11 is shown, and the finial adapter assembly 12 is shown in exploded form.

The most common form of curtain rod 10 is made of wood, so those skilled in the art will realize that the end face 14 of the rod 10 is difficult to finish to be attractive. The easier technique is simply to hide the end of the rod 10, and FIG. 1 illustrates an end cap, or cover, 15. The end cap 15 defines a center hole for receiving a screw or the like to fix the end cap 15 in place. The screw 16 for securing the end cap is a double-ended screw, having a wood-screw thread on one end 18 and a machine-screw thread on the opposite end 19. Such screws exist, but they are not available with any selection of threads or sizes.

The conventional screws such as the screw 16 have machine-screw-threaded ends 19 that are smaller than the conventional lamp finial threads. Thus, an adapter, or bushing, 20 is provided to adapt the screw 16 to the finial 11. The bushing 20 has a central opening sized to receive the machine-screw-threaded end 19, and an external thread sized to receive the machine-screw thread of the finial 11.

Looking at FIG. 2 in conjunction with FIG. 1, it will be seen that the wood-screw-threaded end 18 is received within the end of the curtain rod 10, the end 18 passing through the hole 22 in the end cap 15. The end cap 15 then covers the end 14 of the rod 10, and the bushing 20 is received on the end 19 to hold the end cap 15 in place. Of course, the bushing 20 also adapts the screw 16 to receive a conventional lamp shade finial 11 to complete the assembly.

Those skilled in the art will understand that lamp-shade finials have a threaded base having a ¼-27 thread (¼" in diameter, 27 threads per inch), which is an unusual thread. Nevertheless, this thread has become standard in the lamp shade finial industry. Double-ended screws such as the screw 16 are available as hanger bolts designed to attach hooks to ceilings for use with swag lights and the like. The hanger bolts have the wood screw on the end 18 and the machine screw on the end 19, the machine screw being an 8-32 (8 gauge in diameter and 32 threads per inch) thread. Thus, the bushing 20 must have an internal thread that is an 8-32 machine-screw thread, and an external thread that is a ¼-27 machine-screw thread. It will therefore be readily seen that one could utilize a custom-made screw having the end 18 with a wood-screw thread, and the end 19 with a ¼-27 thread. Alternatively, the pieces as shown in the drawings can be assembled, and the pieces then glued, soldered or the like to create a single member.

Turning to FIGS. 3 and 4 of the drawings, another embodiment of the invention is shown. The embodiment shown in FIGS. 3 and 4 is for use on curtain rods that are conventionally made of steel, around ⅜" in diameter, and having the ends threaded. As with the large wooden rods, the only finials currently available fit over the ends of the rods and are quite large and imposing.

The adapter 24 of the present invention includes an end cap 25 which is receivable on the threaded end 26 of the curtain rod 28. A stud 29 extends co-axially from the cap 25, so the stud 29 extends along the centerline of the curtain rod 28.

The end cap 25 defines a cavity 30 therein, the cavity 30 being threaded to match the threaded end 26 of the rod 28. The stud 29, then, has a ¼-27 thread for receiving a conventional lamp-shade finial 31.

From the above and foregoing discussion it will be understood that the present invention provides an adapter for curtain rods to allow a conventional lamp shade finial to be used as a finial for a curtain rod, opening the vast inventory of lamp shade finials to use on curtain rods. The adapter is very simple, and provides an attractive appearance. For wooden curtain rods and the like, the only change to be made for the different diameters of curtain rod is to change the diameter of the end cap 15. The rest of the assembly can be used with almost any size of rod.

It will of course be understood by those skilled in the art that the particular embodiments of the invention here presented are by way of illustration only, and are meant to be in no way restrictive; therefore, numerous changes and modifications may be made, and the full use of equivalents resorted to, without departing from the spirit or scope of the invention as outlined in the appended claims.

I claim:

1. In combination, a curtain rod, an adapter and a lamp shade finial, said adapter attaching a lamp shade finial to an end of said curtain rod, said lamp shade finial including a base having a threaded opening therein, said threaded opening having a thread standard in the lamp shade finial industry, said adapter comprising an end cap for covering said end of said curtain rod and including a screw having a first end fixed to said one end of said curtain rod and a second end extending from said curtain rod concentric therewith, and threaded means extending from said end cap and concentric with said curtain rod, said threaded means including said thread standard in the lamp shade finial industry and being carried by said end of said screw.

2. The combination as claimed in claim 1, wherein said first end of said screw defines wood-screw threads thereon for engaging said end of said curtain rod, and said second end of said screw defines machine-screw threads thereon.

3. The combination as claimed in claim 2, and further including a bushing receivable on said second end of said screw, said bushing defining a threaded female opening sized for threadedly engaging said machine-screw threads, and an outer surface defining said thread standard in the lamp shade finial industry.

4. The combination as claimed in claim 1, wherein said curtain rod has threads defined on said end of said curtain rod, and said end cap defines an opening having threads therein for engaging said threads on said end of said curtain rod, said threaded means consisting of a stud fixed to said end cap for receiving said lamp shade finial.

5. A curtain rod having a finial fixed to at least one end thereof, comprising an adapter, and a lamp shade finial carried by said adapter, said adapter including a screw having a wood-screw thread on a first end thereof, said first end being threadedly inserted into said at least one end of said curtain rod, said screw having a machine-screw thread on a second end thereof, said second end extending from said end of said curtain rod, said finial being carried by said second end of said screw.

6. A curtain rod as claimed in claim 5, wherein said lamp shade finial includes a base having an opening with a thread standard in the lamp shade finial industry, and said machine-screw thread on said second end of said screw is smaller than said thread standard in the lamp shade finial industry, said adapter further including a bushing received on said screw for providing said thread standard in the lamp shade industry.

7. A curtain rod as claimed in claim 6, and further including an end cap for covering said at least one end of said curtain rod, said end cap defining an opening centrally thereof for receiving said screw therethrough, said end cap being disposed between said curtain rod and said bushing.

8. A curtain rod as claimed in claim 7, wherein said bushing is permanently fixed to said second end of said screw.

* * * * *